United States Patent [19]

Brown et al.

[11] 3,972,646

[45] Aug. 3, 1976

[54] PROPELLER BLADE STRUCTURES AND METHODS PARTICULARLY ADAPTED FOR MARINE DUCTED REVERSIBLE THRUSTERS AND THE LIKE FOR MINIMIZING CAVITATION AND RELATED NOISE

[75] Inventors: Neal A. Brown, Lexington; John A. Norton, Norwell, both of Mass.

[73] Assignee: Bolt Beranek and Newman, Inc., Cambridge, Mass.

[22] Filed: Apr. 12, 1974

[21] Appl. No.: 460,289

[52] U.S. Cl. ..... 416/228; 416/223 B; 415/215

[51] Int. Cl.[2] ..... B63H 1/18; B63H 1/26

[58] Field of Search ..... 416/223, 228; 115/34 R, 115/35; 415/1, 213

[56] References Cited

UNITED STATES PATENTS

| | | | |
|---|---|---|---|
| 1,088,883 | 3/1914 | Donath | 416/228 |
| 1,882,164 | 10/1932 | Ross | 416/223 |
| 2,582,559 | 1/1952 | Pearson | 416/167 |

FOREIGN PATENTS OR APPLICATIONS

| | | | |
|---|---|---|---|
| 10,813 | 9/1933 | Australia | 416/223 |
| 2,103,568 | 10/1971 | Germany | 115/42 |
| 228,177 | 7/1925 | United Kingdom | 115/34 R |

*Primary Examiner*—Everette A. Powell, Jr.
*Attorney, Agent, or Firm*—Rines and Rines

[57] ABSTRACT

This disclosure is concerned with reducing blade-generated cavitation and accompanying noise in systems such as marine ducted reversible thrusters and the like, by novel techniques including a skew-forward blade configuration at the outer radii and particular blade thickness/chord length ratios associated therewith.

11 Claims, 3 Drawing Figures

PROPELLER BLADE STRUCTURES AND METHODS PARTICULARLY ADAPTED FOR MARINE DUCTED REVERSIBLE THRUSTERS AND THE LIKE FOR MINIMIZING CAVITATION AND RELATED NOISE

The present invention relates to propeller and similar thruster blade systems and, more generally, to methods of minimizing cavitation and related noise in underwater and similar thrust-producing structures, being more particularly concerned with minimizing the cavitation and related noise generated by thrust units and the like of the ducted propeller, controllable-reversible pitch type.

The cavitation noise generated by such thruster units has been known severly to interfere with the operation of acoustic positioning and navigation systems on ocean drilling ships, floating rigs, mining ships, pipelaying barges and other vessels so equipped. Erosion caused by cavitation also may cause severe damage to thruster parts such as blades, ducts and struts or even result in failure of such parts.

The before-mentioned ducted propeller of controllable-reversible pitch (CRP) type, as described, for example, in "Design, Model Testing and Application of Controllable Pitch Bow Thrusters", L. Pehrsson and R. G. Mende, Society of Naval Architects and Marine Engineers, New York Metropolitan Section, Meeting of Sept. 29, 1960, is a most attractive type of thruster because of its control simplicity and its use of small, light-weight, constant-speed, aternating-current electrical drive machinery. The thurst is controlled in magnitude and vectored in direction by the control of the propeller pitch. The blades of a CRP thruster propeller are flat; that is, they are untwisted and composed at symmetrical or umcambered foil sections, because of the requirement that they must operate equally well in either direction of thrust production, while maintaining unidirectional rotation. When piched to produce thrust, however, the constant pitch angle blade creates a load distribution quite unlike that of a helical blade. The flat blade is overpitched near the tip and underpitched near the hub, such that the resulting load is concentrated in the outer radii at the expense of loading at inner radii, which could, indeed, actually be negative. While this unusual load distribution may not substantially diminish thruster efficiency, it does increase cavitation, resulting in increased erosion of thruster parts and, quite particularly, increased noise. Increased cavitation results from the overpitched nature of the outer parts of the blades, providing large angles of attack that result in leading-edge cavitation on the suction side. Relative to an open propeller, this condition is aggravated by the maintenance of load to the tip of the ducted thruster propeller.

To obviate cavitation noise, serious restrictions have had to be placed on the maximum thrust either by reducing speed or pitch of thruster units, with obvious disadvantages. Other means of combatting the effects of thruster-generated noise on the acoustic positioning systems have been to increase the acoustic power of positioning system beacons or transponders, with consequences of increased cost, weight, and size, or decreased life. Also, ship-mounted positioning system hydrophones have been made retractable toward or extendable from the hull, and have been variously baffled to reduce their sensitivity to thruster generated noise, again with the disadvantages of increased cost, vulnerability to damage and undesirable constraints on the layout design of a ship, and interference with auxiliary mooring systems, as described, for example, in "Dynamic Stationed — Drilling SEDCO 445", F. B. Williford and A. Anderson, Paper no. OTC 1882, Offshore Technology Conference, Dallas, Texas, 1973; and "Report of Noise Measurements made During Leg 18 of the Deep Sea Drilling Program" (for Global Marine Inc. and Scripps Institute of Oceanology), University of California, W. P. Schneider, September, 1971.

A further proposal to reduce cavitation noise and erosion of some thrusters has been to increase the clearance between blade tip and duct. This, however, has proven to reduce the thrust-producing capability of the unit, as described for example in "Analysis of Ducted-Propeller Design", J. D. Van Manen and N. W. C. Oosterveld, The Society of Naval Architects and Marine Engineers, TRANSACTIONS Volume 74, 1969, pg. 522, and may even be ineffective for noise reduction because of the introduction of a cavitating tip vortex.

The use of thin propeller blades has also been advocated as a means to reduce cavitation, as described, for example, in "The Design of Marine Screw Propellers", T. P. O'Brien, Hutchinson and Co. Ltd., London, 1962. This technique, however, has been found to be effective only to reduce thickness or bubble-type cavitation and not to reduce leading-edge cavitation caused by loading or angle of attack, the latter more important source of cavitation being the subject of the present invention. Reduced thickness, moreover, reduces tolerance to changes in angle of attack as it effects leading-edge cavitation development.

While, however, it has been established that open propellers designed with substantial skew-back in the blade shape may exhibit improved cavitation performance relative to more traditional blade forms, in the design of skewed-back propeller blades, it is necessary substantially to reduce the pitch at the outer radii in order to avoid overloading and premature cavitation which would occur if the pitch distribution of an unskewed blade were maintained. Such techniques are described, for example, in "Highly Skewed Propellers", R. A. Cumming, Wm. B. Morgan and R. J. Boswell, The Society of Naval Architects and Marine Engineers, TRANSACTIONS, Volume 80, 1972, pg. 98; but this type of pitch relief cannot be applied to the blades of a CRP thruster propeller or other structures involving the problem underlying the present invention because, among other reasons, of the bidirectional operational requirement. Skew-back would therefore further overload the tip regions of the blades, aggravating the existing problem.

In accordance with the present invention, however, in summary, it has been discovered that a novel type of skew-forward structure of the blade periphery in the region of its outer radii, coupled with generally larger thickness/chord length ratios than have heretofore been employed in airfoil or similar blade sections, remarkably reduces the cavitation and accompanying noise and other disadvantageous results in such CRP or related thruster systems, and without the difficulties or limitations above-discussed. It is thus a primary object of the invention to provide a new and improved blade structure and method of thus minimizing cavitation and accompanying noise and other deleterious phenomena in such applications.

A further object of the invention is to provide a novel blade structure of more general applicability, as well.

Still a further object is to provide a new and improved technique for marine and related applications for reducing propeller-induced cavitation and resulting noise generation.

Other and further objects will be explained hereinafter, being more particularly delineated in the appended claims.

The invention will now be described with reference to the accompanying drawing,

FIG. 1 of which is a face elevation view of a preferred embodiment, shown for illustrative purposes, as applied to the before-mentioned CRP thruster system;

Figure 1:
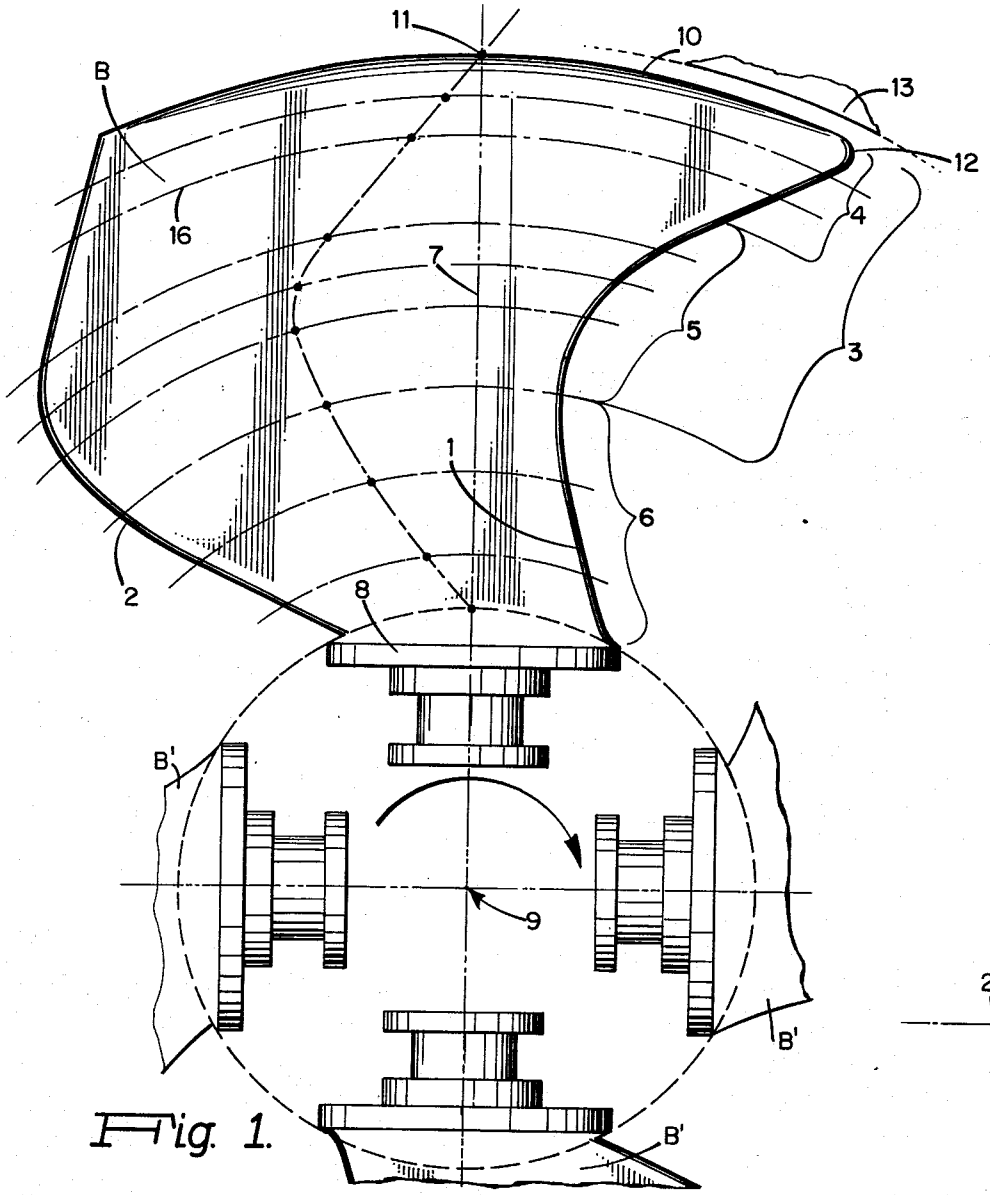
Figure 2:
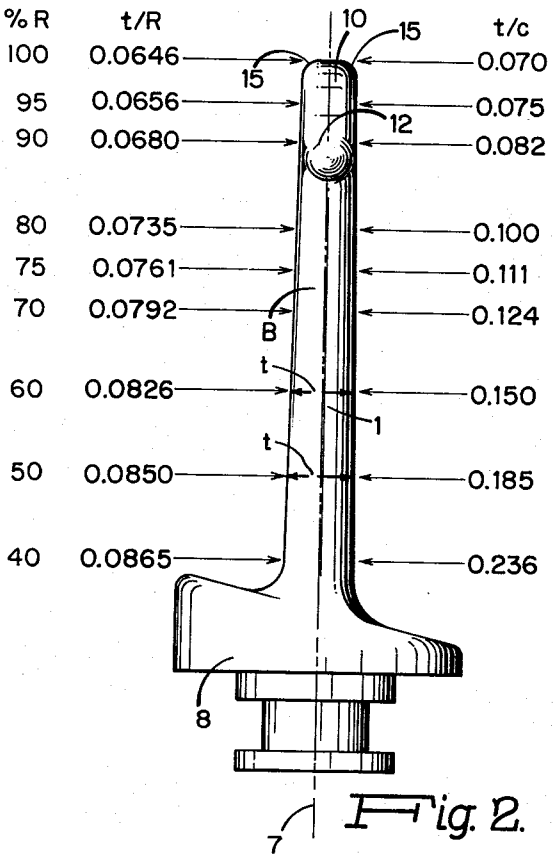
FIG. 2 is a pictorial plot of blade thickness over radius.
Figure 3:
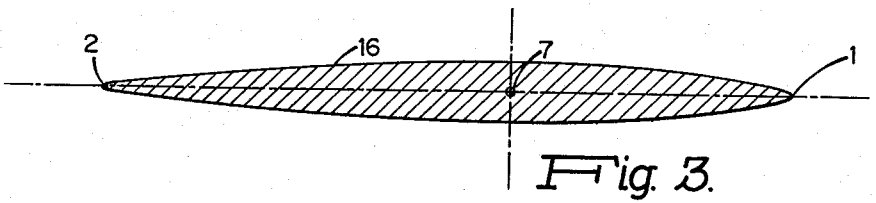
FIG. 3 is a developed view of a typical blade section.

Before considering the illustrative example shown in FIGS. 1, 2, and 3, it is in order to summarize the underlying discovery and features of the invention which emanate from a blade form having a substantial skew-forward of the blade outline or periphery in the region of its outer radii, and blade sections with thicknesses or thickness/chord length ratios substantially larger than those found in current practice—particularly at the outer radii.

The blade form of this invention is therefore characterized by a substantial degree of unorthodox skew-forward in order to shift hydrodynamic load from the cavitation critical tip region to the uncritical root region, thereby improving cavitation performance, as before mentioned. The efficiency of the thruster using this blade shape is equal to that of traditional thrusters.

Thin, sharp-edged propeller blade sections are intolerant to changes in angle of attack from the designed optimum angle in that they tend to cavitate at the leading edge with small load change. Thick sections, with carefully designed rounded leading edges, moreover, such as the NACA 66 series now increasingly used in marine propellers, (see, for example, "Minimum Pressure Envelopes for Modified NACA-66 Sections with NACA a=0.8 Camber and BUSHIPS Type I and Type II Sections", T. Brockett, U.S. Navy, David Taylor Model Basin Report No. 1780, February, 1966), are much more tolerant to increased angle of attack. This tolerance increases, with increasing thickness-chord length ratio; that is the range of angle of attack for leading edge cavitation-free operation at constant cavitation number increases rapidly with thickness. Thickness ratios considerably larger than are common in current practice have been found to be desirable to avoid leading-edge cavitation in the applications of the present invention.

Angle of attack tolerance, and related reduced leading-edge cavitation, however, is ordinarily gained at the expense of thickness cavitation at the lowest cavitation numbers or highest thrust values. The particular skew-forward blade of the present invention however, has been discovered to relieve the overloading on the blade sufficiently to allow some reduction of blade thickness, thereby avoiding thickness cavitation, but without sacrificing the angle of attack tolerance required for reduced leading-edge cavitation. The resulting weight reduction of the blade is valuable because it reduces centrifugal load stresses in the bolts fastening the blade to the CRP hub. In summary, both large thickness/-chord length ratios and the skew-forward blade form are required for a successful blade design for the CRP thruster propeller which will operate with reduced leading-edge cavitation and therefore reduced noise and erosion problems.

While air fan blades have heretofore been proposed with skewed design, as described, for example, in U.S. Pat. No. 2,212,041 and 2,269,287, these are directed to the solution of entirely different problems and are not suited to obviate the problems underlying the present invention. In connection with the fan of the former patent, as an illustration, not only would the sheet-metal thinness of the blade cause cavitation and be useless for the purposes of the present invention (which preferably employs a minimum-thickness-to-chord length ratio $t/c$ of at least not less than about 6%), but if the fan were operated in reverse, it would produce intolerable cavitation. As for fan constructions of the type developed in the latter patent, again employed for a different purpose and function, the blade sections have their thickness design, with thin leading edges, diametrically opposite to that required for the solution of the problems of the present invention, with inadequate skew for such problems (the propeller blades of the present invention preferably having at least of the order of 35°–45° forward skew angle), and if operated in reverse, would generate serious cavitation effects, as well.

An early proposal for forward skewing for a different efficiency problem in a marine propeller is disclosed, for example, in U.S. Pat. No. 1,123,202, but again this falls far short of the reverse-operation, cavitation-suppression solution and the discoveries underlying the same that are involved in the present invention. Such early proposal, indeed, again lacked the proper minimum $t/c$ ratios, provided a totally inadequate blade area (the present invention preferably employing a blade area at least of the order of about 50% of the disc area that circumscribes the propeller), provided knife-edge sections that introduce cavitation, and if operated in the reverse direction, would itself generate serious cavitation.

A preferred blade form for the purposes of the invention is shown in FIGS. 1, 2 and 3, with the peripheral outline of the skewed-forward blade form being illustrated in FIG. 1. The leading edge 1 of the blade B lies to the right in FIG. 1, and the trailing edge 2 lies to the left, the blade B (and one or more companion blades B′) being shown in a thruster duct 13. The blade B has a skew-forward region 3 between about 60% and 100% of the tip radius. In the outer region 4, between about 85% and 100% of the tip radius, the leading edge 1 is oriented at an acute angle of approximately 45° to the radial direction. In the region 5 between about 85% and 60% of the tip radius, there is a smooth transition of the leading edge outline from the skewed-forward outer part to a radial or unskewed condition. At radii in the region 6 between about 60% of the tip radius and the hub radius, the leading edge 1 is skewed-back in order to locate the blade area in an acceptable manner relative to the blade spindle axis 7 and the blade palm 8, the blade being unsymmetrical on each side of the axis 7. For the leading edge, it is apparent that, compared to a corresponding radial (unskewed) edge region, forward skew means that outer elements of an edge region are positioned farther from the axis 7 than a radial edge region (and/or inner elements closer to axis 7 than the radial edge region), while backward skew means that outer elements of an edge region are positioned closer to axis 7 than a radial edge region (and/or inner elements farther from axis 7 than the radial edge region).

The outline of the trailing edge 2 is essentially a facsimile of that of the leading edge except near the tip and the hub. The angle subtended by the blade section chord length at any radius, about the shaft line or axis 9 as center, is approximately constant at about 52.5° in this design. This particular feature is not essential to the attainment of the improvement claimed herein, though it is advantageous in some designs.

The blunt blade tip edge 10 is in the form of a substantially circular cylindrical surface about the shaft axis 9 when the plane of the blade is perpendicular to that axis. This configuration minimizes the clearance between the blade tip and the surrounding cylindrical duct 13. The blade spindle axis passes through the midchord position of the tip section 11 to maintain the minimum clearance when the blade is turned to an operating pitch angle. The intersection of the leading edge 1 with the blade tip at 12, is preferably rounded to a roughly ellipsoidal shape with a minor radius approximately equal to the nose radius of the blade section at the tip and a somewhat larger major radius. The edges formed by the intersections of the two face surfaces of the blade with the tip surface at 15 are rounded with a radius of approximately 10% of the maximum tip section thickness.

A pictorial plot of the blade thickness t over the blade radius R is shown in the table of FIG. 2. The blade thickness at any blade section is conventionally defined as the maximum value of the dimension between the opposite faces of the blade, as indicated in FIG. 2 for several blade sections. In the right-hand column of that table are listed the blade section thickness/chord length ratios $t/c$, opposite their appropriate radii, which are preferred in accordance with this blade design. In the left-hand column there are listed the blade section thickness/propeller blade tip radius ratios $t/R$, opposite their appropriate radii, also preferred for this illustrative blade design. The distributions of thickness and chord length are the subject of design calculations based on the thruster size, operating conditions, and thrust requirements, with values illustrated representing a useful embodiment. It should be noted, moreover, that the thickness ratios at the outer radii are considerably larger than those found in current or past practice. As shown in FIG. 2, the outer region of the blade (the region most distant from axis 9) does not taper to a sharp edge. The thickness-to-chord ratios remain at least about 6% at the outer sections of the blade substantially to the surface at the tip edge 10, with the thickness of the blade being substantially the same at the tip edge surface 10 as at adjacent sections closer to axis 9.

In FIG. 3 is shown a developed view of the blade section 16 which resembles a wing-section or airfoil-like shape, (hereinafter sometimes referred to as hydrofoil shape), as distinguished from the thin or fore-and-aft symmetrical propeller blade sections generally employed in thruster applications, as before discussed. The blade thus has an untwisted, non-helical, nominally planar median surface with uncambered hydrofoil sections.

Model tests have been carried out in controlled pressure water tunnel facilities comparing a thruster fitted with a propeller of the design of FIGS. 1, 2 and 3 with the same thruster fitted with a propeller of the existing traditional design having unskewed or radial edged blades with small thickness/chord length ratios.

At the full thrust pitch settings appropriate to the two blade designs and at the appropriate cavitation number, the traditional propeller blade design was subject to steady cavitation at the leading edge on the suction side from approximately 50% radius to the tip, in both directions of operation. Cavitation also occurred in an apparent vortex, trailing back from the point of the leading edge-tip intersection and in the gap between the blade tip and duct wall.

In contrast, when operating in the direction such that the pod struts were downstream of the propeller, the propeller with the blade form of the invention, as shown in FIGS. 1, 2 and 3, yielded no cavitation except restrictively only in the gap between the blade tip and the duct wall, and of much lesser extent than that of the traditional form. When operated with the struts upstream of the propeller, this same minimal tip gap cavitation was produced, with also a small patch of leading edge suction side cavitation when and only when each blade B, B′ passed directly behind the thickest strut or through its wake. Consequently, the underwater noise generated and erosion damage has been significantly reduced. The skewed-forward blade design of the invention, moreover, was found, additionally, to require the same or less input power for the same thrust.

The same tests run with an unskewed radial-edge design blade having thickness ratios in excess of those set forth in FIG. 2, moreover, showed highly unacceptable thickness or bubble cavitation.

It will be evident to those skilled in the art that various modifications of thruster propeller blades may be developed in accordance with the principles disclosed herein, and all such are considered to fall within the spirit and scope of the invention as defined in the appended claims.

What is claimed is:

1. A fully immersed propeller bade structure for providing reduced cavitation and noise in marine and related applications, said structure having a substantially circular cylindrical blunt tip edge with a surface connecting opposite faces of said blade structure, a leading edge with at least a forwardly skewed radially outer region on one side of the blade structure axis, and a trailing edge of the same general outline as the leading edge but unsymmetrically disposed on the other side of said axis, the blade structure being substantially flat and untwisted and having sections of hydrofoil shape and the minimum blade section thickness-to-chord ratio being at least about 6%, the thickness of said blade structure at said tip edge surface being substantially the same as the thickness at adjacent sections of said blade structure, to provide angle of attack tolerance for avoidance of leading edge cavitation, the forward skew of said leading edge region relieving inherent blade tip overloading while permitting blade section thickness appropriate for avoidance of thickness cavitation.

2. A propeller blade structure as claimed in claim 1 and in which the said axis passes through substantially the midchord position of the tip edge.

3. A propeller blade structure as claimed in claim 1 and in which the intersection of the said tip edge with the leading edge is substantially ellipsoidal in shape.

4. A propeller blade structure as claimed in claim 1 disposed with duct means.

5. A propeller blade structure as claimed in claim 4 and in which means is provided for operating said blade structure within said duct means as a reversible thruster while rotating unidirectionally.

6. A propeller blade structure as claimed in claim 1 and in which the leading edge region radially inward of said outer region curves in a smooth transition to a radial condition, and then to a backwardly skewed condition.

7. A propeller blade structure as claimed in claim 6 and in which said forwardly skewed region is skewed at an acute angle of approximately 35° to 45°.

8. A propeller blade structure as claimed in claim 1 connected with hub means at the inner end and with further similar propeller blade structure means extending from said hub means to constitute a propeller.

9. A propeller blade structure as claimed in claim 8 having an associated duct and in which said propeller is disposed in the duct and the blade area is at least of the order of about 50% of the duct area at the propeller.

10. A propeller blade structure as claimed in claim 1 and in which the ratios of the blade section thickness $t$ to tip radius R for blade sections at different percentages of the radius R are as follows:

| % R | t/R |
|---|---|
| 100 | 0.0646 |
| 95 | 0.0656 |
| 90 | 0.0680 |
| 80 | 0.0735 |
| 75 | 0.0761 |
| 70 | 0.0792 |
| 60 | 0.0826 |
| 50 | 0.0850 |
| 40 | 0.0865. |

11. A propeller blade structure as claimed in claim 1 and in which the ratios of blade section thickness $t$ to chord length $c$ at different percentages of the tip radius R are as follows:

| % R | t/c |
|---|---|
| 100 | 0.070 |
| 95 | 0.075 |
| 90 | 0.082 |
| 80 | 0.100 |
| 75 | 0.111 |
| 70 | 0.124 |
| 60 | 0.150 |
| 50 | 0.185 |
| 40 | 0.236. |

* * * * *